US011254548B2

(12) United States Patent
Eiwan

(10) Patent No.: US 11,254,548 B2
(45) Date of Patent: Feb. 22, 2022

(54) METHOD FOR BRINGING A WORK MACHINE INTO A WEATHERVANE POSITION, AND WORK MACHINE FOR CARRYING OUT THE METHOD

(71) Applicant: LIEBHERR-WERK BIBERACH GMBH, Biberach an der Riss (DE)

(72) Inventor: Christoph Eiwan, Ummendorf (DE)

(73) Assignee: LIEBHERR-WERK BIBERACH GMBH, Biberach an der Riss (DE)

( * ) Notice: Subject to any disclaimer, the term of this patent is extended or adjusted under 35 U.S.C. 154(b) by 824 days.

(21) Appl. No.: 16/074,402

(22) PCT Filed: Feb. 1, 2017

(86) PCT No.: PCT/EP2017/000128
§ 371 (c)(1),
(2) Date: Jan. 15, 2019

(87) PCT Pub. No.: WO2017/133841
PCT Pub. Date: Aug. 10, 2017

(65) Prior Publication Data

US 2021/0188602 A1 Jun. 24, 2021

(30) Foreign Application Priority Data

Feb. 1, 2016 (DE) ..... 10 2016 001 037.1

(51) Int. Cl.
*B66C 23/88* (2006.01)
*B66C 13/48* (2006.01)
(Continued)

(52) U.S. Cl.
CPC ..... *B66C 23/88* (2013.01); *B66C 13/48* (2013.01); *B66C 23/84* (2013.01); *B66C 23/022* (2013.01);
(Continued)

(58) Field of Classification Search
CPC ..... B66C 23/022; B66C 23/16; B66C 23/166; B66C 23/84; B66C 23/88; B66C 13/48; B66C 2700/0392; E04G 21/0427
See application file for complete search history.

(56) References Cited

U.S. PATENT DOCUMENTS

2010/0006530 A1* 1/2010 Juraszek ..... B66C 23/04 212/272
2018/0065835 A1* 3/2018 Haase ..... B66C 23/022

FOREIGN PATENT DOCUMENTS

DE 102010008713 A1 8/2011
DE 102015104148 A1 9/2016
(Continued)

OTHER PUBLICATIONS

ISA European Patent Office, International Search Report Issued in Application No. PCT/EP2017/000128, dated May 19, 2017, WIPO, 4 pages.

*Primary Examiner* — Michael R Mansen
*Assistant Examiner* — Juan J Campos, Jr.
(74) *Attorney, Agent, or Firm* — McCoy Russell LLP

(57) ABSTRACT

The invention relates to a method of weathervaning a work machine in out-of-operation mode, in particular of weathervaning a revolving crane/revolving tower crane or a concrete spreader mast, wherein the work machine comprises at least one slewing part that is rotatable about a substantially vertical axis by means of a slewing gear, and wherein in a first step one or more wind data are measured by means of a measurement system arranged at the work machine; an optimum position of the slewing part is determined for an optimum weathervaning in dependence on the detected wind data; and the slewing gear drive is subsequently correspondingly actuated to bring the slewing part into the determined position.

16 Claims, 1 Drawing Sheet

(51) Int. Cl.

| | |
|---|---|
| ***B66C 23/84*** | (2006.01) |
| ***B66C 23/02*** | (2006.01) |
| ***B66C 23/16*** | (2006.01) |
| ***E04G 21/04*** | (2006.01) |

(52) U.S. Cl.
CPC .... *B66C 23/166* (2013.01); *B66C 2700/0392* (2013.01); *E04G 21/0427* (2013.01)

(56) References Cited

FOREIGN PATENT DOCUMENTS

| | | | |
|---|---|---|---|
| JP | 2010083659 | A | 4/2010 |
| WO | 2016146827 | A1 | 9/2016 |

* cited by examiner

METHOD FOR BRINGING A WORK MACHINE INTO A WEATHERVANE POSITION, AND WORK MACHINE FOR CARRYING OUT THE METHOD

CROSS-REFERENCE TO RELATED APPLICATION

The present application is a U.S. National Phase of International Patent Application Serial No. PCT/EP2017/000128, entitled "METHOD FOR BRINGING A WORK MACHINE INTO A WEATHERVANE POSITION, AND WORK MACHINE FOR CARRYING OUT THE METHOD," filed on Feb. 1, 2017. International Patent Application Serial No. PCT/EP2017/000128 claims priority to German Patent Application No. 10 2016 001 037.1, filed on Feb. 1, 2016. The entire contents of each of the above-mentioned applications are hereby incorporated by reference in their entirety for all purposes.

TECHNICAL FIELD

The invention relates to a method of weathervaning a work machine that is characterized by at least one slewing part that is rotatable about a substantially vertical axis by means of a slewing gear. In addition to the method in accordance with the invention, the present invention additionally relates to a work machine for performing such a method.

BACKGROUND AND SUMMARY

Work machines, in particular revolving cranes or revolving tower cranes or concrete spreader masts, are affected that are designed such that they have to have sufficient weathervaning and directional stability in out-of-operation mode to avoid overloads of the support structure.

The taking of a work machine, in particular of a crane, out of operation is called directionally stability or also weathervaning. The slewing gear brake of the work machine is here typically mechanically permanently open to maintain the slewing part of the work machine, typically the boom in cranes, freely rotatable in the wind. The crane boom or the slewing part can rotate out of the wind independently without any technical drive due to the attacking wind load.

With a sufficient wind strength the boom ultimately faces the downwind side. In this position, the wind force increasing with the wind strength acts as wanting to tilt the mast toward the downwind side; however, the constant moment of tilt of the counterweights acts in the opposite direction so that a sufficient stability of the crane is ensured. The crane is always held in a position having the smallest air resistance by this measure and a maximum stability of and/or a minimal structural load on the construction is achieved.

On a comparison of different standards on determining wind loads, it was, however, found that the theoretical wind loads on work machines are represented differently depending on the standard used. An increase in the calculated wind load assumptions recently resulted with the introduction of the new European crane calculation standard EN 13001-2 and the general wind load building industry standard EN 14439 (2009).

It has also been able to be determined in independent wind load tests that the previously assumed model of an ideal directional stability does not satisfy a number of practical cases and work machines at times show a different behavior on wind influence in the out-of-operation mode. The different behavior is mainly due to disruptions of the prevailing wind field that are due to the construction circumstances in the closer proximity of the machine surroundings. Buildings, for example, cause wind turbulence that makes more difficult or prevents the desired independent orientation of the crane in a weathervaning position.

Solutions are therefore being looked for with respect to weathervaning of a work machine that stands in a disrupted wind field due to surrounding buildings and in which a weathervaning in a conventional manner does not satisfy the demands.

This object is achieved by a method of weathervaning a work machine in out-of-operation mode, in particular of weathervaning a revolving crane/revolving tower crane or a concrete spreader mast, wherein the work machine comprises at least one stewing part that is rotatable about a substantially vertical axis by means of a slewing gear, comprising the method steps: measuring one or more pieces of wind data by means of a measurement system arranged at the work machine; determining an optimum position of the slewing part for an optimum weathervaning of the work machine in dependence on the measured wind data; and actuating the slewing gear drive to bring the slewing part into the determined position. Advantageous embodiments of the method are the subject of the subordinate claims dependent on the main claim.

The gist of the invention is an active weathervaning of the work machine. Unlike in the prior art, an independent rotational movement of the slewing part of the work machine generated by wind force should no longer be relied on, but instead an active regulation of the slewing gear drive should take place to bring the slewing part of the work machine in a target-oriented manner into the optimum position for the weathervaning. One or more pieces of wind data are detected in advance for this purpose by means of a measurement system arranged at the work machine. The optimum position of the slewing part is then determined on the basis of the detected wind data and are made use of for the control of the slewing gear drive to travel the slewing part into the optimum position. Consequently, at least one desired value for a desired slew angle of the slewing gear is determined.

By traveling to the optimum position, the slewing part of the work machine should be rotated out of the wind and ideally face lee so that a position with the smallest air resistance always results. The work machine is thereby actively monitored and automatically controlled in the out-of-operation mode to always provide maximum stability and/or a minimized structural load on the construction.

The method can be carried out continuously or cyclically to ensure a dynamic adaptation of the optimum position in dependence on the changing wind conditions.

Supplementary wind data can optionally be detected in addition to the measurement data determined at the work machine. These supplementary wind data are not detected directly at the work machine, but in the closer proximity of the machine environment, preferably at a point in the closer proximity of the machine environment that is subject to smaller external disruptive influences on a prevailing wind field so that an almost non-disrupted wind field is detected on the basis of these supplementary wind data. Ideally, suitable external wind sensors are installed at or on higher platforms or buildings. For example, a recording of the wind data can take place at an upper floor of a building neighboring the work machine.

The combination of the wind data directly detected at the work machine and the supplementary wind data permits an improved modeling or calculation of the attacking wind load to determine an optimum position for the weathervaning based thereon.

There is a possibility of not only controlling the slewing gear drive, but rather to simultaneously regulate it so that the determined optimum position is also maintained with attacking wind loads.

In a preferred embodiment variant, a wind speed recording and/or a wind direction recording takes/take place directly at the work machine, ideally distributed over a plurality of positions at the work machine, by means of the measurement system. The wind speed recording and/or the wind direction recording should at least take place at the rotatable part of the work machine, for example at the top of the crane with a work machine in the form of a revolving crane. The arrangement of wind sensors at the boom tip and/or at the counter-tip and/or at the tower tip is particularly preferred.

The supplementary wind data of the external sensor system can likewise record the wind speed and the wind direction of the almost non-disrupted wind field.

The structural load on the work machine on one or more regions or components of the work machine is further preferably detected by the measurement system. Ideally, a structural load is determined by a measurable expanding and/or compressive deformation of the material structure in the examined machine part. A measurement of the structural load in the region of the tower base, in particular in the region of the corner bars of a lattice piece installed in the tower base, has proved to be particularly preferred with work machines in the form of revolving cranes or revolving tower cranes. Sensors are sensibly installed at each of the corner bars to be able to determine the load of each corner bar. The measurable structural load in the region of the tower base, in particular of the corner bars, is a good indicator for the effective moment of tilt of the crane.

The measurement of the structural load preferably takes place via one or more strain gauges that preferably detect stretching and/or compressive deformations in the longitudinal tower direction.

It is likewise desirable that any safety demands of the control system of the work machine, for example specifications with respect to the maximum slewing speed or the acceleration, are observed in the control and/or regulation of the slewing great for active weathervaning.

In addition to the method in accordance with the invention, the present invention relates to a work machine, in particular to a revolving tower crane or a concrete spreader mast, having at least one slewing part that is rotatable about a vertical axis by means of a slewing gear. In accordance with the invention, the work machine comprises at least one measurement system that determines corresponding wind data at the machine and forwards them to a machine control, with the machine control being designed such that, in accordance with the present invention, it performs the method in accordance with the invention. The advantages and properties of the work machine obviously correspond to those of the method in accordance with the invention so that a repeat description will be dispensed with.

BRIEF DESCRIPTION OF THE FIGURES

Further advantages and properties of the invention will be explained in the following with reference to the embodiments shown in the drawings. There are shown.

DETAILED DESCRIPTION

Figure 1:
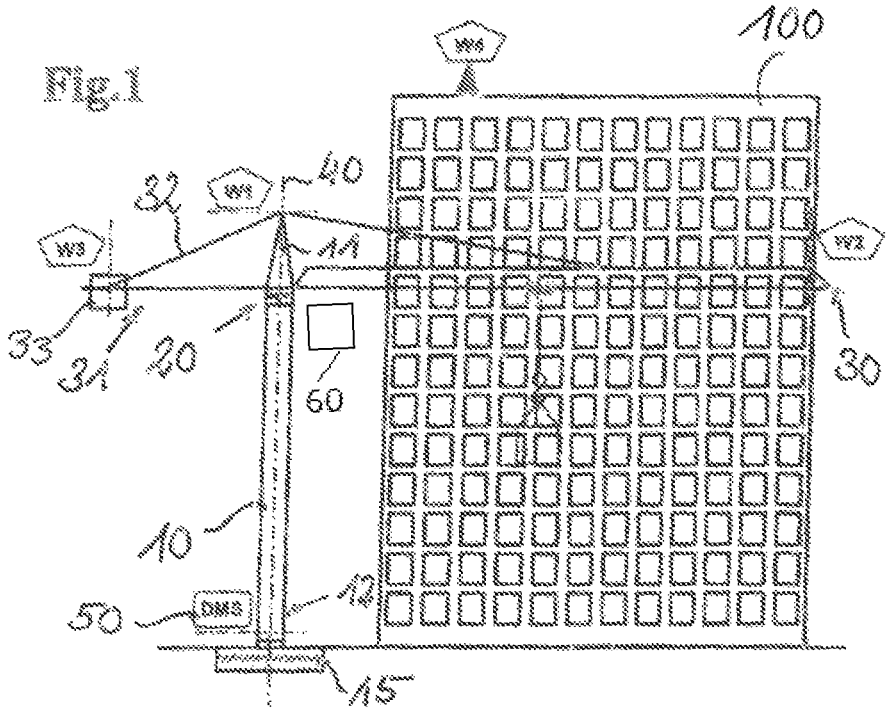
FIG. 1 shows a sketched lateral representation of a revolving tower crane for performing the method in accordance with the invention.

FIG. 1 shows a top-slewing tower crane known per se. The tower crane comprises a crane tower 10 that is fixedly anchored to the crane foundation 15.

A slewing gear 20 is located at the upper end of the crane tower 10 that receives the boom 30 and that permits a rotational movement of the boom 30 about a vertically standing axis of rotation 40 with respect to the crane tower 10. The boom 30 and the counter-boom 31 are guyed via the guying 32 at the crane tip 11.

A higher building 100 that causes turbulence or disruptions of the prevailing wind field in the region of the tower crane is located in the direct environment of the tower crane. The previously known passive methods for weathervaning no longer satisfy the safety demands on the out-of-operation mode of a revolving tower crane due to the environmentally induced disruption of the prevailing wind field. For this reason, the crane control of the revolving tower crane of FIG. 1 performs the method in accordance with the invention as soon as the out-of-operation mode is activated for the crane.

The revolving tower crane is expanded to include a measurement apparatus whose wind sensors are installed distributed over the crane structure for the performance of the method. Suitable wind sensors are in particular arranged in a distributed manner to the slewing part of the crane structure in the form of the sensor W1 at the tower tip 11 or in the region of the guying 32, of the wind sensor W2 at the boom tip of the boom 30, and of the wind sensor W3 in the direct proximity of the counter-ballast 33 at the counter-boom 31.

All the wind sensors W1, W2, and W3 continuously record the wind speed and the wind direction and forward their measurement data to the crane control 60.

A respective at least one strain gauge 50 per corner bar of the installed lattice piece of the tower base is fastened in the region of the tower base 12 close to the crane foundation 15 to detect the structural load of the tower base on the basis of the stretching or compressive deformation of the corner bars. The measurable deformations are an indication for the moment of tilt acting on the crane.

In addition to the wind data of the sensors W1, W2, W3 collected at the crane, an external wind sensor W4 is installed on the roof of the neighboring building 100 and likewise records the wind speed or wind direction in the region of the upper floor of the building 100. Since the wind sensor W4 is considerably higher than the crane structure, a non-disrupted wind field can be assumed in this region.

The collected measurement data of the sensors W1, W2, W3 of the strain gauges 50 in combination with the supplementary wind data of the external sensor W4 are evaluated within the crane control and are used to determine an optimum position of the boom 30, 31 for the weathervaning of the crane. Since the wind data are continuously determined, a dynamic adaptation of the optimum position of the upper crane to the variable wind field takes place in the crane control. The slewing gear is regulated by the crane control while taking account of the computed desired position to move the boom system 30, 31 to and hold it at the desired position.

Figure 2:
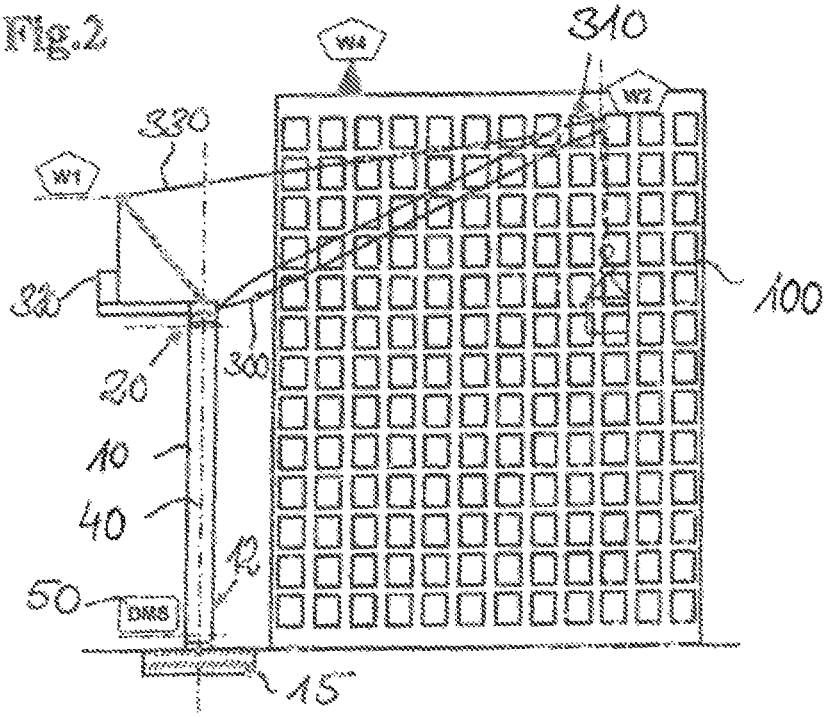
FIG. 2 shows a sketched lateral representation of an alternative revolving crane for performing the method in accordance with the invention.

The embodiment of FIG. 2 shows an alternative revolving crane. Identical components to the embodiment of FIG. 1 are provided with identical reference numerals. Only the construction differences will therefore be looked at in the following.

The revolving crane shown in FIG. 2 comprises an upper crane that is rotatable about the axis 40 by means of the slewing gear 20 and that provides a crane boom 300 luffably arranged at the crane tower 10 and the counter-ballast 320. The luffing movement of the boom 300 is achieved via the luffing cabling 330. In the embodiment of FIG. 2, the wind sensors W1, W2 are arranged once in the region of the luffing cabling 330 in the proximity of the counter-ballast 320 (W1) and once in the region of the boom tip 310 (W2).

Analog to the embodiment of FIG. 1, a measurement of supplementary wind data takes place by an external sensor W4 in the roof region of the neighboring building 100. The structural load of the crane is likewise detected by arranged strain gauges 50 in the region of the tower base 12. The optimum position of the boom 300 rotatable about the axis 40 is calculated by the crane control as in the example of FIG. 1 and is traveled to by a regulated control of the slewing gear 20. There is equally the possibility of additionally taking account of the luffing angle of the boom 300 for the determination of the optimum position of the upper crane and optionally to control the corresponding luffing operation.

The invention claimed is:

1. A method of weathervaning a work machine in out-of-operation mode, wherein the work machine comprises at least one slewing part that is rotatable about a substantially vertical axis by means of a slewing gear, comprising the method steps:

measuring one or more pieces of wind data by means of a measurement system arranged at the work machine;

determining an optimum position of the slewing part for an optimum weathervaning of the work machine in dependence on the measured wind data; and actuating the slewing gear drive to bring the slewing part into the determined position, wherein one or more further machine drives are controlled and/or regulated in addition to the slewing gear for the traveling to the determined optimum position.

2. The method in accordance with claim 1, wherein the method is performed continuously or cyclically to travel the slewing part into a dynamically changeable optimum position.

3. The method in accordance with claim 1, wherein, in addition to the wind data measured at the work machine, supplementary wind data in the machine environment are detected by one or more external sensors and are taken into account for the determination of the optimum position.

4. The method in accordance with claim 3, wherein the supplementary wind data are detected in a machine environment region in which a non-disrupted wind field or a wind field that has fewer disruptive influences than in the region of the work machine prevails.

5. The method in accordance with claim 1, wherein a regulation of the slewing gear drive is performed to maintain the slewing part in the determined optimum position.

6. The method in accordance with claim 1, wherein the measurement system detects wind speed and/or wind direction in a distributed manner at different points of the slewing part of the work machine.

7. The method in accordance with claim 6, wherein the measurement system detects the wind speed and/or the wind direction in a region of a boom tip and/or at a counter-boom and/or at a tower tip.

8. The method in accordance with claim 1, wherein the measurement system detects a structural load of the work machine in one or more regions of the work machine, and the detected load measurement values are taken into account for the determination of the optimum position.

9. The method in accordance with claim 8, wherein stretching and/or compressive deformations of material structure are detected at the one or more positions.

10. The method in accordance with claim 9, wherein the stretching and/or compressive deformations are detected by use of a plurality of strain gauges.

11. The method in accordance with claim 8, wherein the measurement system detects the structural load in a region of corner bars of a tower base.

12. The method in accordance with claim 1, wherein any safety demands in a control system of the work machine are taken into account on the control and/or regulation of the slewing gear drive for the active weathervaning.

13. The method in accordance with claim 1, wherein the work machine is a revolving crane/revolving tower crane or a concrete spreader mast.

14. The method in accordance with claim 1, wherein the one or more further machine drives is a luffing gear.

15. A work machine having at least one slewing part that is rotatable about a vertically standing axis by means of a slewing gear, having a measurement system, and having a machine control to perform a method of weathervaning the work machine in out-of-operation mode, comprising the method steps: measuring one or more pieces of wind data by means of the measurement system arranged at the work machine, determining an optimum position of the slewing part for an optimum weathervaning of the work machine in dependence on the measured wind data, and actuating a slewing gear drive to bring the slewing part into the determined optimum position, wherein one or more further machine drives are controlled and/or regulated in addition to the slewing gear for the traveling to the determined optimum position.

16. The work machine in accordance with claim 15, wherein the work machine is a revolving tower crane or a concrete spreader mast.

* * * * *